United States Patent [19]

Spars et al.

[11] Patent Number: 4,507,195

[45] Date of Patent: Mar. 26, 1985

[54] COKING CONTAMINATED OIL SHALE OR TAR SAND OIL ON RETORTED SOLID FINES

[75] Inventors: Byron G. Spars, Mill Valley; Robert J. Klett, San Francisco; P. Henrik Wallman, Berkeley, all of Calif.

[73] Assignee: Chevron Research Company, San Francisco, Calif.

[21] Appl. No.: 495,297

[22] Filed: May 16, 1983

[51] Int. Cl.[3] ..... C10G 1/00; C10G 9/32

[52] U.S. Cl. ..... 208/11 R; 208/106

[58] Field of Search ..... 208/11 R, 50, 131, 106

[56] References Cited

U.S. PATENT DOCUMENTS

| | | | |
|---|---|---|---|
| 2,726,998 | 12/1955 | Findlay | 208/11 R |
| 3,018,243 | 1/1962 | Nevens | 208/11 |
| 3,034,979 | 5/1962 | Nevens | 208/11 |
| 3,093,571 | 6/1963 | Fish et al. | 201/42 X |
| 3,320,152 | 5/1967 | Nathan et al. | 208/11 R |
| 3,560,367 | 2/1971 | Parker | 208/11 R |
| 3,954,597 | 5/1976 | Morrell | 208/11 |
| 4,071,433 | 1/1978 | Hanson | 208/106 |
| 4,071,434 | 1/1978 | Gifford | 208/106 |
| 4,082,650 | 4/1978 | Li | 208/131 |
| 4,113,602 | 9/1978 | Gorbaty et al. | 208/8 |
| 4,157,245 | 6/1979 | Mitchell et al. | 48/197 R |
| 4,183,800 | 1/1980 | Mitchell et al. | 208/11 R |
| 4,199,432 | 4/1980 | Tamm et al. | 208/8 |
| 4,219,402 | 8/1980 | DeGeorge | 208/8 |
| 4,227,990 | 10/1980 | Dearth et al. | 208/11 R |
| 4,246,093 | 1/1981 | Wolcott | 208/8 |
| 4,289,603 | 9/1981 | DeGeorge | 208/8 |
| 4,320,795 | 3/1982 | Gwyn et al. | 165/1 |

OTHER PUBLICATIONS

Cameron Synthetic Fuels Report, Mar., 1981.

*Primary Examiner*—Delbert E. Gantz
*Assistant Examiner*—Lance Johnson
*Attorney, Agent, or Firm*—S. R. La Paglia; J. W. Ambrosius; D. P. Freyberg

[57] ABSTRACT

Heavy oil fraction of pyrolysis oil vapors containing concentrated contaminants is coked on retorted fine solids contained in a coking zone separate from a retorting vessel characterized by the presence of an inert stripping gas of a rate sufficient to lower the dew point of the pyrolysis oil.

8 Claims, 4 Drawing Figures

COKING CONTAMINATED OIL SHALE OR TAR SAND OIL ON RETORTED SOLID FINES

BACKGROUND OF THE INVENTION

Oil shale is a naturally occurring material which contains a hydrocarbonaceous component referred to as kerogen. Upon heating, the kerogen decomposes to release a hydrocarbon vapor which may be used as a feedstock in petroleum processing. This synthetic crude oil called "shale oil" contains relatively high levels of iron, arsenic, and nitrogen as compared to conventional petroleum. In addition, due to the fissile nature of the raw oil shale and to the friability of the inorganic residue remaining after pyrolysis, the shale oil is also contaminated with a significant amount of fine solids which may constitute as much as 10% by weight of the pyrolysis oil. This contamination usually must be reduced prior to downstream processing to prevent poisoning of the various catalysts and clogging of the equipment.

Another naturally occurring raw material for production of pyrolysis oil is tar sand that occurs naturally in a variety of forms including fine-grain diatomite. In analogy to the kerogen in oil shale, bitumen in tar sands may be pyrolyzed to yield a pyrolysis oil similar to shale oil. Particulate contamination in tar sands derived oil is similar to that in shale oil.

The present invention is directed to a process for recovering pyrolysis oil from oil shale or tar sands or significantly reduced contamination and having a lower average molecular weight than otherwise may be recovered by the pyrolysis of these raw materials.

BRIEF DESCRIPTION OF THE INVENTION

The present invention is directed to an improved process for retorting a particulate hydrocarbonaceous solid comprising both coarse and fine particles to recover pyrolysis oil of a lower average molecular weight and containing reduced contamination, said hydrocarbonaceous solid being selected from the group consisting of oil shale and tar sands, the process comprising:

(a) mixing the particulate raw hydrocarbonaceous solid with a particulate hot heat-transfer material to raise the raw hydrocarbonaceous solid to a temperature sufficient to pyrolyze the hydrocarbons therein;

(b) retaining the mixture of step (a) in a pyrolysis zone for a time sufficient to decompose a significant amount of the raw hydrocarbonaceous solid to yield hydrocarbon vapors;

(c) passing a stripping gas through the mixture in the pyrolysis zone at a rate sufficient to significantly lower the dew point of the evolved hydrocarbon vapors and to entrain the fine particles;

(d) recovering from the pyrolysis zone a mixture of contaminated hydrocarbon vapors, stripping gas, and entrained fine particles;

(e) separating at least some of the fine particles from the contaminated hydrocarbon vapors and stripping gas and introducing said fine particles to a fluidized bed contained in a coking zone separate from the pyrolysis zone;

(f) condensing from the contaminated hydrocarbon vapors a high-boiling fraction containing concentrated contaminants;

(g) contacting the contaminated high-boiling fraction with the fine particles contained in the coking zone, whereby the high-boiling fraction is thermally cracked and the contaminants are deposited along with coke on the fine particles in the fluidized bed;

(h) withdrawing product oil vapors from the coking zone havng a lower average molecular weight and having substantially reduced contamination as compared to the high-boiling fraction.

The term "hydrocarbonaceous solids" refers to oil shale and tar sands. The term "inert stripping gas" refers to a non-oxidizing gas such as steam, nitrogen, carbon dioxide, recycle gas, natural gas, etc.

As used herein, the word "contamination" or "contaminants" refers to fine solids, metals, and non-metals which must be removed prior to refining. Thus, the term includes fine particles of pyrolyzed or feed solids, heat-transfer material, and coke as well as compounds containing iron, nitrogen, arsenic, magnesium, calcium, sodium, sulfur, etc.

The heat-transfer material is preferably recycled pyrolyzed oil shale or tar sand which has been passed through a combustion zone to burn off any carbonaceous residue to provide heat for pyrolyzing the raw material. Other suitable heat-transfer materials include particulate solids such as sand, rock, alumina, steel, ceramic compositions, etc., as well as mixtures of these materials.

Various types of retorting vessels are suitable for use with the present invention. In one preferred embodiment the retorting vessel is a vertical vessel designed to control the gross vertical backmixing of the solids. For example, a retorting vessel employing a moving packed bed or a staged turbulent bed (see U.S. Pat. No. 4,199,432) would be satisfactory for practicing the process. The presence of stripping gas in the pyrolysis oil vapor serves to lower the condensation temperature for a given heavy oil fraction. A lower temperature prevents premature coking of the heavy oil fraction in the heavy oil condenser. The high-boiling fraction may be in a liquid or partially liquid-partially vapor state when entering the coking zone. Steam may be added to the high-boiling fraction for atomization prior to injection into the coking zone. The hot bed of fine solids provides a satisfactory medium for coking the contaminated hydrocarbon fraction and for depositing the contaminants along with the coke onto these fine pyrolysis solids. The coke on the fine pyrolysis solids is utilized for heat generation by passing the solids through the combustion zone together with the het transfer material.

DETAILED DESCRIPTION OF THE INVENTION

Figure 1:
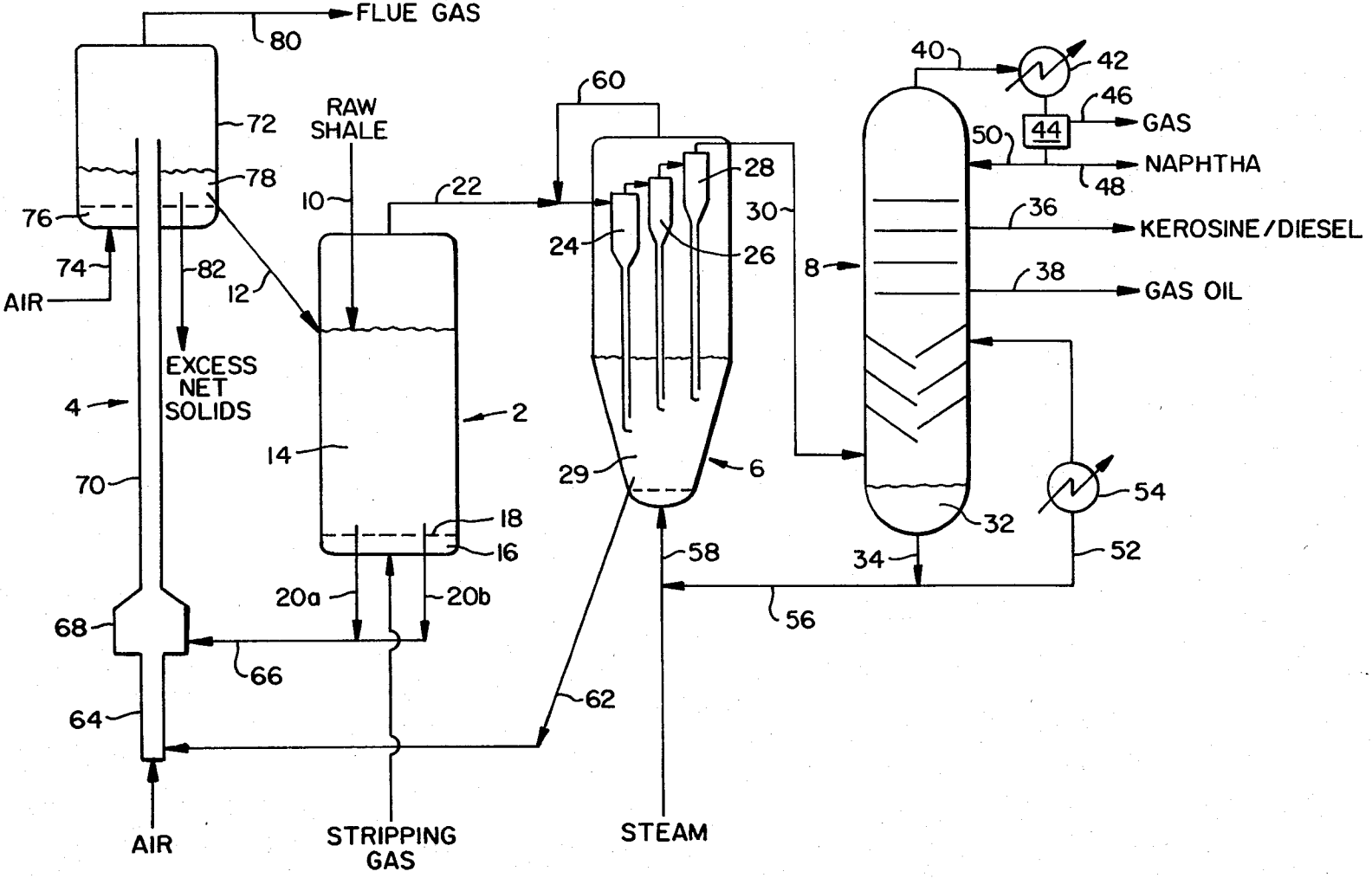
FIG. 1 illustrates a process for recovering shale oil from oil shale using the fluidized coking zone described herein.

The present invention is most easily understood by reference to the drawings. Shown in FIG. 1 is a scheme for recovering shale oil from oil shale. One skilled in the art will recognize that with appropriate modification the same basic process may also be employed to recover product oil from tar sand.

Shown in FIG. 1 is a retorting vessel 2, a combustor 4, a coking vessel 6, and a fractionator 8. In the retorting vessel the particulate raw shale feed entering the retort via conduit 10 is mixed with hot heat-transfer material entering by way of recycle feed pipe 12 to form a bed of solids 14. An inert stripping gas is introduced into plenum chamber 16 and passes upward through distributor grate 18 and through the bed of solids. Depending upon the velocity of the stripping gas the bed of solids may be fluidized or only partially fluidized. At low gas velocities the bed may also form a vertical moving packed bed. However, as will be discussed later the velocity of the stripping gas must be sufficient to significantly lower the dew point of the high-boiling fraction. A mixture of pyrolyzed solids and heat-transfer material is withdrawn from the retort via drawpipes 20*a* and 20*b*.

The product vapor released upon pyrolysis of the oil shale and the stripping gas will entrain fine particles formed mainly by the attrition of larger particles in the bed. These fine particles are mostly pyrolyzed or partially pyrolyzed material with a relatively minor component derived from the heat carrier material. This is due to the relatively low mechanical strength of the pyrolyzed shale particles. The gases and entrained fines leave the retort via outlet conduit 22 and are carried to the coking vessel 6. In the coking vessel the gases pass through a series of cyclones designated 24, 26 and 28 which remove most of the entrained fines and collect them in the fluidized bed of solids 29 contained in the lower portion of the coking vessel. The product vapors and entrained fines not collected by the cyclones leave the coking vessel via conduit 30 and are sent to the fractionator 8 where the raw shale oil is separated from non-condensible gas and lighter products.

In the embodiment shown the contaminants are selectively enriched in the fractionator bottoms 32 which is withdrawn via conduit 34. Kerosene/diesel and gas oil are removed from the fractionator via conduits 36 and 38, respectively, while light overhead gases are recovered by overhead outlet 40. The overhead gases pass through cooler 42 where the condensible gases are cooled sufficiently to become liquid. In separator 44 non-condensible gases are recovered via outlet 46 separately from naphtha which is recovered via conduit 48. Naphtha is recycled to the top of the fractionator via recycle conduit 50.

The heavy oil collected as bottoms is either recycled to the fractionator via conduit 52 and cooler 54 or alternatively is sent to the coking vessel 6 via conduit 56.

One skilled in the art will recognize that other means besides the fractionator shown in FIG. 1 may be employed to collect the heavy oil. For example, the heavy oil may be collected in a spray tower cooled by recycle oil or by water injection. The means used is not important so long as the heavy oil may be collected with the contaminants separately from the lower boiling products.

The heavy oil enriched with contaminants passing via conduit 56 is mixed with steam, and the steam/oil mixture enters the bottom of the coking zone via conduit 58 to fluidize the bed of fine particles 29. In an alternate embodiment the heavy oil may be introduced directly into the fluidized bed of the coking zone. In the embodiment shown the temperature of the bed in the coking vessel will be in the range of from about 850° F. to about 975° F., depending upon the temperature at which the retorting vessel 2 is maintained. Under these conditions, the heavy oil will be thermally cracked to produce a lower boiling product of reduced molecular weight. The coke deposited on the particles in the bed will also contain most of the particulate matter and most of the iron, magnesium, sodium, and calcium and a fraction of the nitrogen and arsenic.

In addition to acting as a coking zone for the heavy oil, the coking vessel also serves as a secondary pyrolysis zone for fines which were only partially pyrolyzed in the retorting vessel. The cracked vapors and steam from the coking vessel are collected by outlet 60 and mixed with the product vapors in conduit 22 from the retort. Most entrained fines are removed by the series of cyclones 24, 25 and 26 noted earlier.

In the embodiment shown the coked particles from the coking vessel 6 are carried to the combustor 4 via conduit 62. The fines are entrained in a flow of air and carried up a liftpipe 64 which acts as a fines preburner. Returning to the retort, the mixture of heat-transfer material and pyrolyzed shale leaving the retort is carried by conduit 66 to the coarse solids engaging section 68 of the main liftpipe 70 of the combustor 4. The mixture of fines from the preburner 64 and the coarser solids from the engaging section 68 pass up the main liftpipe 70 where at least part of the carbonaceous residue remaining in the pyrolysis solids is burned. Coke deposited in the coking vessel would be burned at the same time if not already combusted in the preburner 64. The partially burned particles exit the top of the liftpipe 70 and enter the secondary combustion and separation chamber 72. Secondary air entering the bottom of chamber 72 via secondary air inlet 74 and plenum 76 serves as fluidization gas for the fluidized bed 78 in the bottom of the chamber and as a source of oxygen for the combustion of any unburned carbon residue in the solids. The flue gas and fines leave the combustor by means of flue gas outlet 80.

Excess solids which are not recycled to the retort are removed from the system by drawpipe 82. Preferably, the secondary combustion and separation chamber is designed to separate the finger more friable material from the coarser more attrition resistant particles which are more desirable for use as heat-transfer material. The hot particles of burned material in the bed 78 are recycled as heat-transfer material to the retort via recycle conduit 12. The heat-transfer material entering the retort will usually have a temperature in the range of from about 1000° F. to about 1500° F.

As already noted the design of the retorting vessel may take a number of forms so long as it is adapted to employ a heat-transfer material and a stripping gas which in the present scheme is essential to lower the dew point of the heavy oil. Likewise, the design of the combustor may take any number of known forms so long as it is able to supply a sufficient quantity of heat-transfer material at a temperature capable of heating the raw shale to a sufficiently high temperature for primary pyrolysis in the retort and secondary cracking in the coking vessel to occur with adequate reaction kinetics. Various designs for the coking zone may also be contemplated by one skilled in the art. Generally, the coking zone will employ either a fluidized or partially fluidized bed of fine retorted solids.

Figure 2:
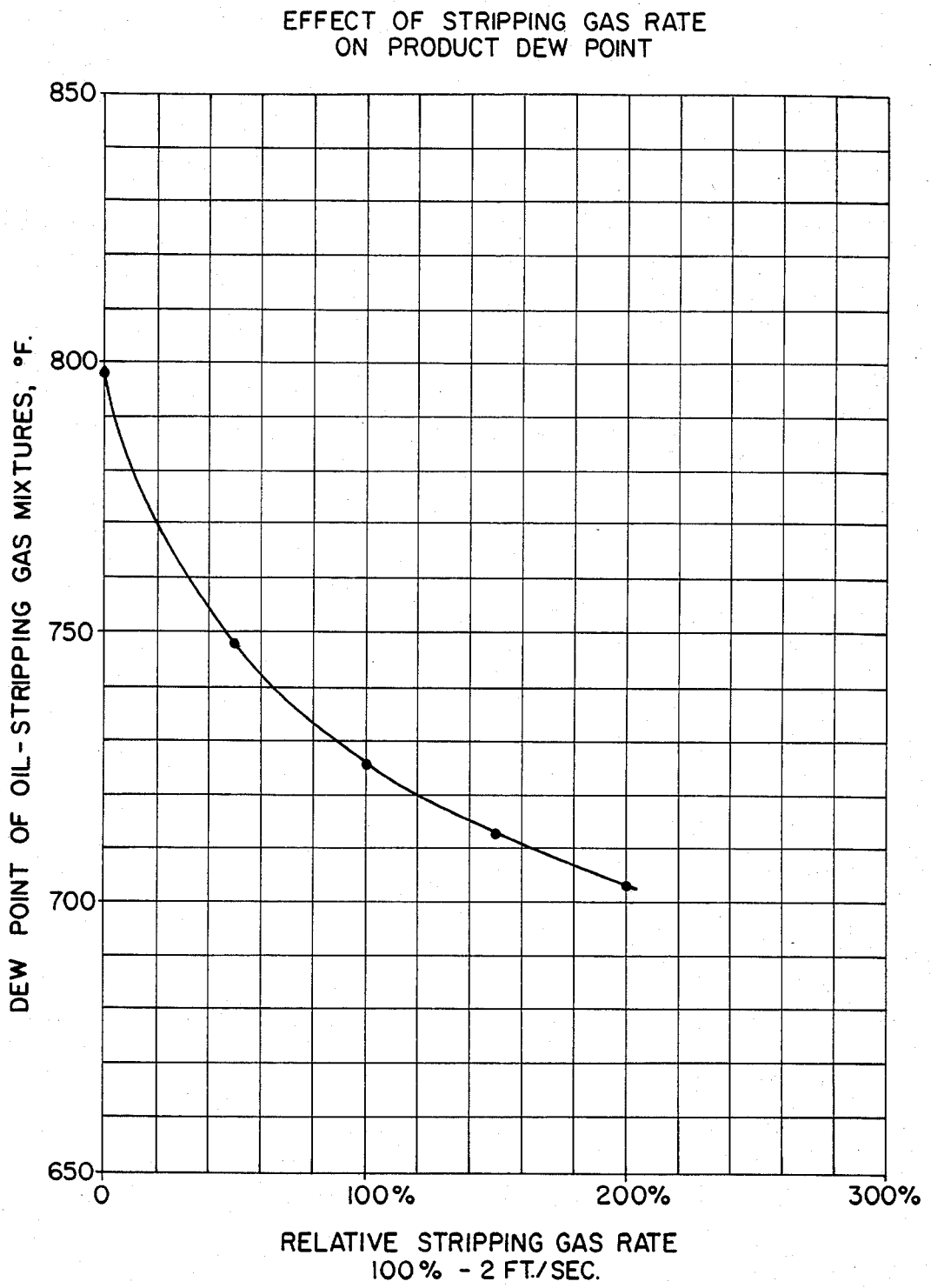
FIG. 2 is a graph illustrating the change in dew point observed in shale oil resulting from different stripping gas rates.

The importance of the presence of stripping gas in the shale oil vapor for the purpose of the invented process is demonstrated by FIG. 2. FIG. 2 shows the dew point of shale oil vapor-stripping gas mixtures as a function of injected stripping gas rate (100% corresponds to 10 moles of stripping gas per average mole of oil produced or a superficial stripping gas velocity of about 2 ft/sec. for a raw shale throughput of 4,000 lbs/hr. $ft^2$ and a shale grade of 27 Gal/Ton). An increase in stripping gas rate from 0 to 100% is shown to decrease the dew point by 70° F. This means that a heavy oil condenser with 100% stripping gas can be operated at a temperature approximately 70° F. lower than the corresponding case without stripping gas (same heavy oil fraction condensed).

Figure 3:
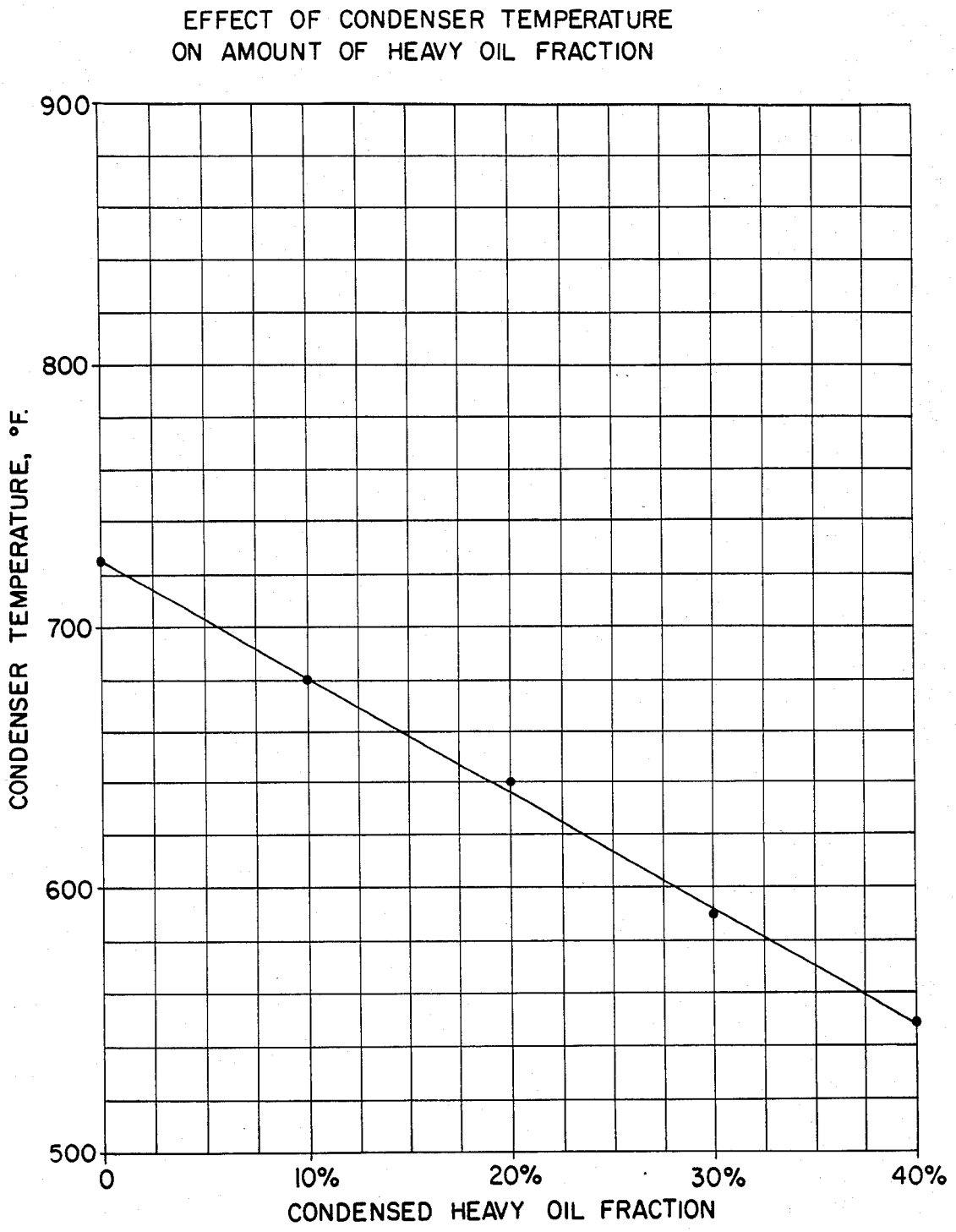
FIG. 3 shows in graphic form the effect of condensation temperature on the amount of heavy oil fraction.

FIG. 3 shows the amount of heavy oil condensed as a function of condenser temperature for the 100% stripping gas case. It is seen that a condenser temperature in the range 680°-550° F. produces a heavy oil fraction amounting to 10–40% of the primary shale oil production. Heavy oil temperatures higher than about 650° F. are undesirable because of the rapid coking reactions that occur at these elevated temperatures in the liquid-phase heavy oil. Rapid coking can result in plugging of the entire condenser system. Consequently, in the absence of stripping gas it is necessary to condense a much larger heavy oil fraction because of the dew point effect. This in turn leads to increased coke yield in the cracking step thus reducing the net oil yield.

Figure 4:
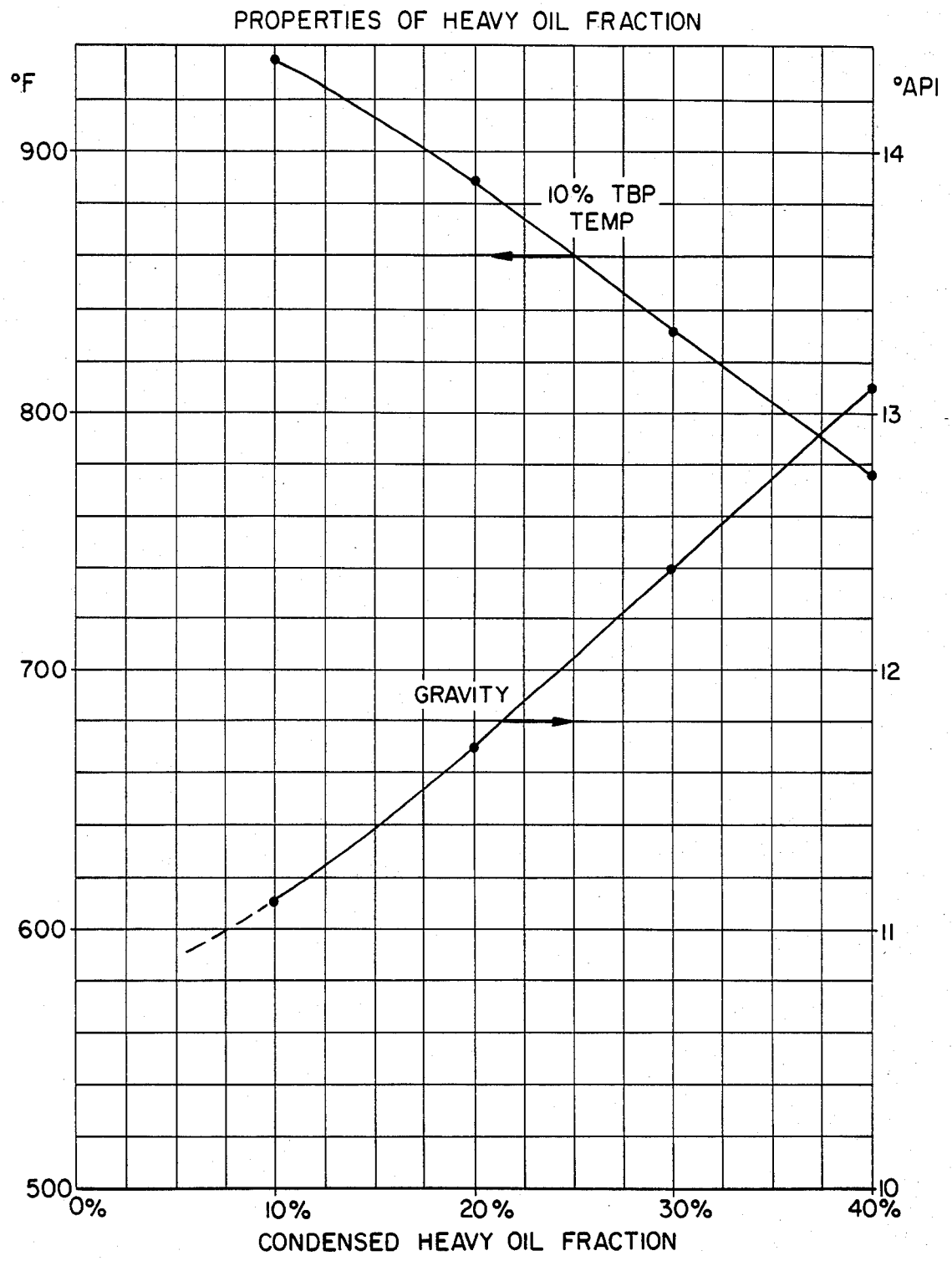
FIG. 4 shows the physical properties of the heavy shale oil fraction.

FIG. 4 shows the 10% true-boiling point temperature and the API gravity of the condensed heavy oil fraction. For comparison, the primary shale oil has a 10% TBP temperature of 300° F. and a gravity of 22° API. A 10% heavy oil fraction is seen to be mostly 935° F.+ material (90% boiling above 935° F.), a 20% heavy oil fraction is 890° F.+ and a 30% heavy oil fraction is 830° F.+. Thus, one skilled in the art will recognize that by lowering the dew point of the pyrolysis oil, it is possible to condense the contaminants in a smaller high-boiling fraction. As noted above, this objective may be accomplished by passing a stripping gas through the retort during pyrolysis of the raw feed.

In carrying out the invention, preferably at least 90% of the high-boiling fraction will have a boiling point above about 850° F. and more preferably above 950° F.

What is claimed is:

1. An improved process for retorting a raw particulate hydrocarbonaceous solid comprising both coarse and fine particles to recover pyrolysis oil of a lower average molecular weight and containing reduced contamination, said hydrocarbonaceous solid being selected from the group consisting of oil shale and tar sand, the process comprising;

(a) mixing, at the top of a vertical retorting vessel designed to control gross vertical backmixing, the raw particulate hydrocarbonaceous solid with a hot particulate heat-transfer material comprising combusted, pyrolyzed hydrocarbonaceous solids to raise the raw hydrocarbonaceous solid to a temperature sufficient to pyrolyze the hydrocarbons therein;

(b) passing the mixture of step (a) downward through a pyrolysis stage while retaining it in the stage for a time sufficient to decompose a significant amount of the raw hydrocarbonaceous solid to yield hydrocarbon vapors, and whereby fine particles comprising primarily at least partially pyrolyzed hydrocarbonaceous solid are also formed;

(c) passing a stripping gas through the mixture in the pyrolysis stage at a rate sufficient to significantly lower the dew point of the evolved hydrocarbon vapors and to entrain the fine particles in the pyrolysis zone;

(d) recovering from the top of the pyrolysis stage a mixture of contaminated hydrocarbon vapors, stripping gas, and entrained fine particles;

(e) withdrawing, from the bottom of the pyrolysis stage, a mixture of retorted particulate hydrocarbonaceous solids and the heat-transfer material;

(f) separating at least some of the fine particles from the contaminated hydrocarbon vapors and stripping gas and introducing said fine particles into a coking stage, separate from the pyrolysis stage, comprising a fluidized bed;

(g) condensing from the contaminated hydrocarbon vapors at a temperature between 550° F. and 680° F. a high-boiling fraction containing concentrated contaminants, said high-boiling fraction comprising at least 90% hydrocarbons having a boiling point above 850° F.;

(h) contacting the contaminated high-boiling fraction with the fine particles contained in the coking stage, which fine particles consist essentially of the fine particles formed in step (b) and separated in step (f), at a temperature between about 850° F. and 975° F., whereby the high-boiling fraction is thermally cracked in contact with the fine particles to produce oil vapors and the contaminants are deposited along with coke on the fine particles;

(i) withdrawing the product oil vapors having a lower average molecular weight and having substantially reduced contamination compared to the high-boiling fraction from the coking stage;

(j) withdrawing coked fine particles from the coking stage;

(k) combusting the coked fine particles of step (j) and the mixture of solids of step (e) in a combustion stage to form a hot particulate heat-transfer material; and (l) recirculating at least a portion of the material of step (k) to step (a).

2. The process of claim 1 wherein the hydrocarbonaceous solid is oil shale.

3. The process of claim 1 wherein the hydrocarbonaceous solid is tar sand.

4. The process of claim 1 wherein the coked fine particles of step (j) and the mixture of solids of step (e) are fed separately into the combustion stage of step (k).

5. The process of claim 1 wherein in step (1) the portion of the material which is recirculated to step (a) comprises a coarse fraction of the material.

6. The process of claim 1 wherein the pyrolysis stage comprises a staged turbulent bed.

7. The process of claim 1 wherein at least 90% of the high-boiling fraction boils above about 950° F.

8. The process of claim 1 wherein the coking stage also serves as a secondary pyrolysis stage for fine particles carried into the coking stage and not completely pyrolyzed in the pyrolysis stage.

* * * * *